US010672210B2

(12) United States Patent
Girani et al.

(10) Patent No.: US 10,672,210 B2
(45) Date of Patent: Jun. 2, 2020

(54) COMMUNICATION DEVICE AND METHOD FOR COMMUNICATION

(71) Applicant: ams AG, Premstaetten (AT)

(72) Inventors: Elisa Girani, Torrazza Coste (IT); Vinko Kunc, Ljubljana (SI); Francesco Cavaliere, Graz (AT); Maksimiljan Stiglic, Maribor (SI)

(73) Assignee: ams AG, Premstaetten (AT)

( * ) Notice: Subject to any disclaimer, the term of this patent is extended or adjusted under 35 U.S.C. 154(b) by 0 days.

(21) Appl. No.: 16/079,989

(22) PCT Filed: Feb. 17, 2017

(86) PCT No.: PCT/EP2017/053645
§ 371 (c)(1),
(2) Date: Aug. 24, 2018

(87) PCT Pub. No.: WO2017/148714
PCT Pub. Date: Sep. 8, 2017

(65) Prior Publication Data

US 2019/0066421 A1 Feb. 28, 2019

(30) Foreign Application Priority Data

Feb. 29, 2016 (EP) ..... 16157893

(51) Int. Cl.
*G07C 9/00* (2020.01)

(52) U.S. Cl.
CPC ..... *G07C 9/00309* (2013.01); *G07C 2009/00809* (2013.01); *G07C 2209/65* (2013.01)

(58) Field of Classification Search
CPC ..... G07C 9/00309; G07C 2009/00809; G07C 2209/65
USPC ..... 340/5.61, 5.1, 5.5, 5.51, 5.6
See application file for complete search history.

(56) References Cited

U.S. PATENT DOCUMENTS

| | | | | |
|---|---|---|---|---|
| 8,508,356 | B2 * | 8/2013 | Shuster | G06F 1/1684 340/522 |
| 2004/0064728 | A1 | 4/2004 | Scheurich | |
| 2006/0252371 | A1 | 11/2006 | Yanagida | |
| 2011/0227856 | A1 * | 9/2011 | Corroy | H04B 13/005 345/173 |
| 2012/0003929 | A1 | 1/2012 | Hyoung et al. | |
| 2013/0057415 | A1 | 3/2013 | Kim et al. | |
| 2015/0048927 | A1 * | 2/2015 | Simmons | G07C 9/00309 340/5.61 |
| 2015/0213661 | A1 | 7/2015 | Robertson et al. | |

FOREIGN PATENT DOCUMENTS

| | | | |
|---|---|---|---|
| CN | 104393889 | A | 3/2015 |

* cited by examiner

*Primary Examiner* — Yong Hang Jiang
(74) *Attorney, Agent, or Firm* — Fish & Richardson P.C.

(57) ABSTRACT

A communication device (10) comprises a conductor (11), a transceiver (12) coupled to the conductor (11) and a data processing unit (13) that is coupled to the transceiver (12). The communication device (10) is configured to determine a strength signal (ST) depending on a receiver signal (SR) received via the conductor (11) and to determine a proximity signal (SP) depending on a proximity of a body to the communication device (10). The data processing unit (13) is configured to generate a disable signal (STO) depending on at least a value of the strength signal (ST) and on at least a value of the proximity signal (SP).

13 Claims, 4 Drawing Sheets

10
11
12
13
14
15
16
17
18
20
21
22
30
31
32
SR
SP
ST
SE
STO
SOUT
Tx/Rx
$C_{Tx/Rx}$ 40
41
42
43
44
45
46
47
48
49
10
11
Proximity sensor detection
Received power signal detection
Rx
Proximity sensor detection
Proximity sensor detection
Received power signal detection
Receiver

COMMUNICATION DEVICE AND METHOD FOR COMMUNICATION

TECHNICAL FIELD

The present disclosure is related to a communication device and a method for communication.

BACKGROUND

In a communication arrangement, a communication device communicates with a further communication device. There may be more than two communication devices in an area or more than two persons in an area. Thus, methods have to be used to achieve a secure communication. For example, a communication device may be coupled to an electrical door lock. A person having a further communication device with an authentication code may be near the door. For security reasons, the door may not be opened in the case that a further person enters the space between the person and the door.

There is a desire to provide a communication device and a method for communication with increased security.

SUMMARY

In an embodiment, a communication device comprises a conductor, a transceiver coupled to the conductor and a data processing unit coupled to the transceiver. The communication device is configured to determine a strength signal depending on a receiver signal received via the conductor and to determine a proximity signal depending on a proximity of a body to the communication device. The data processing unit is configured to generate a disable signal depending on at least a value of the strength signal and on at least a value of the proximity signal.

Advantageously, the disable signal not only depends on one, but on two signals. Thus, the security that the communication device is communicating with a predetermined further communication device such as a transmitter is increased.

The proximity signal may increase, when the proximity of the body to the communication device increases. The strength signal may increase, when the receiver signal gets stronger.

In an embodiment, the data processing unit generates the disable signal, when the strength signal decreases and the proximity signal increases. Advantageously, the disable signal is generated, when a body such as a further person enters the space between the communication device and the predetermined other communication device and causes a reduction of the strength signal and an increase of the proximity signal. The body may be a person but also an object such as clothing, furniture, door, paper and so forth.

In an embodiment, the data processing unit does not generate the disable signal when at least one condition is detected out of a group comprising a first condition that the strength signal increases or is constant and a second condition that the proximity signal decreases or is constant. During at least of one of said conditions, the communication device maintains the communication.

In an embodiment, the data processing unit generates the disable signal when the strength signal decreases larger than a predetermined strength value in a predetermined time and the proximity signal increases larger than a predetermined proximity value in the predetermined time. Advantageously, the influence of noise or small fluctuations of the strength signal and the proximity signal is reduced.

In an embodiment, the data processing unit generates the disable signal, when the strength signal decreases under a predetermined strength limit value and/or the proximity signal decreases under a predetermined proximity limit value.

In an embodiment, the data processing unit stops a communication, when the disable signal is generated. If the disable signal obtains a first logical value, than the communication is stopped. If the disable signal obtains a second logical value, than the communication is maintained.

In an embodiment, the communication device comprises a memory that stores at least one authentication code. The data processing unit generates an output signal, if an authentication code received by the receiver signal is equal to one of the authentication codes stored in the memory and the disable signal is not set. The output signal may be for example trigger the opening of a door of a car or a building.

In an embodiment, the data processing unit comprises an analog-to-digital converter that is configured to generate at least one of a digitized strength signal out of the strength signal and a digitized proximity signal out of the proximity signal.

The conductor is realized as electric conductive conductor.

In an embodiment, the conductor is implemented as an antenna that is configured to receive electromagnetic waves. The receiver signal can be tapped at the antenna. The antenna may be electromagnetically coupled to a further antenna.

In an embodiment, the conductor is implemented as a signal plate. The signal plate may be connected or capacitively coupled to the body. The receiver signal can be tapped at the conductor respectively the signal plate. The plate may be realized as electrode. In an example, the signal plate may not be fixed to the body; thus, the signal plate may not permanently connected or capacitively coupled to the body.

In an embodiment, the conductor and the transceiver are configured such that the proximity signal is derived from the receiver signal or another signal tapped at the conductor. The proximity signal depends on a distance of the body to the conductor. The conductor may be realized as the signal plate.

In an embodiment, the communication device comprises a proximity sensor. The proximity sensor generates the proximity signal. The proximity sensor may use a capacitive, an inductive, a resistive or a light sensitive principle. The proximity sensor may comprise a light-emitting diode and a photodiode. The proximity sensor may be realized as human body contact sensor or touch sensor.

In an embodiment, the communication device comprises a ground plate configured for capacitive coupling to a reference potential. The reference potential may be an earth potential or the potential of a person. Alternatively, the communication device comprises a ground terminal that is electrically connected to a reference potential.

In an embodiment, a communication arrangement comprises the communication device and a further communication device such as a transmitter.

In an embodiment, the further communication device such as the transmitter communicates with the communication device via human body communication.

In an embodiment, the communication device is connected to an electric door opener.

In an embodiment, the transmitter is realized as a wristwatch.

In an embodiment, an authentication code may be stored in the further communication device. The communication device may also store at least one authentication code in the memory. When the communication device receives the authentication code from the further communication device and said received code is identical with a code of the at least one authentication codes stored in the communication device and, additionally, the disable signal is not set, then the communication device provides an output signal. The output signal may for example trigger the opening of a door of a house, a room or car.

In an embodiment, a method for communication comprises receiving a receiver signal by a conductor of a communication device, converting the receiver signal into a strength signal by the communication device, determining a proximity signal by the communication device depending on a proximity of a body to the communication device and generating a disable signal by the communication device depending on at least a value of the strength signal and on at least a value of the proximity signal.

Advantageously, the disable signal can be generated in a versatile manner.

Advantageously, the proximity sensor is designed for communication protection in the communication arrangement using human body communication. The communication arrangement may also be named communication system or system. The communication device may be called apparatus or communication apparatus.

The communication device may have a human body as the medium for the communication. Moreover, the communication device may comprise a human body contact or proximity sensor.

The communication arrangement or system where communication is entirely within, on, and in the immediate proximity of a human body may be implemented as body area network, abbreviated as BAN. BAN devices may be embedded inside the body such as implants, may be surface-mounted on the body in a fixed position such as devices realized by wearable technology or may be accompanied devices that humans can carry in different positions, such as in clothes pockets, by hand or in various bags. The communication arrangement may communicate on or around a human body like a sport-watch that controls, collects and displays information from at least one wireless sensor on a human body. A network may comprise several miniaturized body sensor units, abbreviated BSUs, together with a single body central unit, abbreviated BCU. Another communication arrangement may send data like a music stream or data to be displayed in a watch.

The communication arrangement may use HF frequencies that can use the human body to propagate electrical fields. The communication arrangement may exploit the properties of human body to propagate an electrical field.

Advantageously, the communication device may make BAN transmission secure and accurate. The personal authentication data is only derived from each person's dedicated BAN system and is not mixed up with other authentication data. Further, the data generated from BAN have secure and limited access. Additionally, BANs may be designed for high communication reliability. Although BANs are resource-constrained in terms of power, memory, communication rate and computational capability, BANs may achieve a high security. Confidentiality, authentication, integrity and freshness of data together with availability and secure management are the security requirements in BAN.

In an embodiment, the communication device includes: an electrode that comes in contact or in close proximity to the human body, performs the human body communication and is also connected to a contact sensor that instructs the transceiver to perform an initial operation, if proximity with the communication device is sensed (the electrode may be named conductor); a second electrode that is capacitively coupled to the earth ground to perform the return path for the human body communication (the second electrode may be named ground plate); and a data processing unit that compares the received signal strength immediately before or after the proximity with the communication device has been detected, selects whether to transmit or receive data, and performs a transmitting or receiving operation according to the control signal. The proximity sensor can be used also to switch on the human body communication arrangement or system.

In an embodiment, the system's transmitter and receiver electrodes correspond to antennas for a wireless system. The electrodes are coupled with the human body trough capacitive coupling. Through this coupling, the transmitter electrode modulates the body area electric field, and the receiver electrode reads and demodulates the electric field and outputs a signal. A feature of the communication arrangement is that the transmitter and the receiver can communicate with each other even if one of them is in the user's pocket or underneath a carpet on the floor, because signals travel over the surface of the user's human body.

In an embodiment, to enhance the security of the communication arrangement when using a human body as a communication medium, the human body proximity sensor is included. With this device (and detecting the received signal strength), the communication arrangement is able to discriminate, if the proximity switch has been triggered by a person 'wearing' the transceiver or by another person. The transceiver or transmitter may be realized as authentication device.

Using the touch (or extreme proximity) and being able to discriminate between the touch of a person with authentication and the one without, the communication only happens in a communication arrangement, where the clear intent is shown from the person having the authentication device.

When the person in possession of the authentication device is close enough to the receiving device for communication to be performed and the transmitter (realized as authentication device) is sending data, a possibility exists that the proximity sensor is triggered by a further person not in possession of the authentication device. In such a case authentication should not be performed as this was not the intention of the person having the possession of the authentication device.

The communication device that is the receiving device may solve this task by using the following procedure: The communication arrangement works like this: The receiving device compares the received signal strength during the time proximity is detected with the received signal strength shortly after proximity detection is not detected (or shortly before it is detected). If the signal strength during detected proximity is stronger, this clearly indicates the proximity (touch) was caused by the person in possession of the authentication device. If, instead, the signal gets weak during the proximity detection, this means that something is present in between and the communication should stop.

The communication arrangement is designed such that communication (authentication) happens only, if the person in position of the authentication device touches or gets in extreme proximity of the receiving device.

The human body communication arrangement or system uses a proximity sensor able to sense touch (or extreme proximity) and to discriminate between the touch of a person with authentication and one without so that it can ensure the communication only happens when there is clear intent of the person having the authentication device. The proximity switch signal, in combination with the receive signal strength immediately before or after the proximity has been detected, allows the communication arrangement to determine if the proximity switch has been triggered by a person 'wearing' the transceiver (authentication device) or by another person.

The communication arrangement may be designed as a safe human body communication system regarding the possible presence of other bodies who can detect the authentication information or interfere with a human body who wants to start to transfer data trough human body communication.

Additionally, the communication arrangement performs a reliable communication between the transceivers placed on or close to the body. They are not taking care to achieve a clear distinction, if the device is on the body, very close to the body or a bit further away. This is not a problem for some BAN applications like where a signal from a heart monitor or a music stream is send. But this becomes an issue if one targets authentication of a person wearing an authentication device, like bracelet or watch, and can be achieved by the described communication arrangement.

To allow authentication of such person to the communication device, the authentication data from a bracelet or similar device needs to be transferred to the communication device in question. The communication device may be implemented as or may be connected to a door-lock, a mobile phone, a computer keyboard, a mouse or a head phone. In such use cases authentication should be triggered only, if the person shows clear intent he/she wishes to do so and only to the communication device he/she intends to send the authentication. External devices, other human beings or objects coming near the person should not trigger authentication.

The task of a human body present in proximity of the two devices exchanging authentication information via human body communication is solved using a proximity sensor. The proximity sensor may be a capacitive, resistive, light sensitive or other proximity sensor. The communication device asses the receive signal strength during the proximity switch high and compares to the receive signal strength immediately before or after the proximity has been detected. In this way the communication device can discriminate if the proximity switch has been triggered by a person wearing the transceiver (that is the authentication device) or by another person and it will by disabling the communication in order not to share the personal information with the other people present in proximity.

The communication arrangement may be able to limit the data exchange (authentication) between a person having a human body communication device (that may be a transmitter) on or close to his/hers body and the communication device based on the proximity of the communication device from the body of the person in question.

This limitation may be performed with means of the proximity (or touch) sensing device as a part of the communication device and where the communication device can discriminate between the triggering of the proximity sensor (either capacitive, resistive, light sensitive or other sensor) by a person having the authentication device (e.g. the transmitter) on or close to his/hers body and a touch of a person not having such device.

The limit of data exchange may be performed by comparing the receive signal strength seen by the communication device during different states or values of the proximity signal in a manner that the higher signal strength at closer proximity of the body is interpreted as proximity or touch by a person which has the authentication device (e.g. the transmitter) on or close to his/hers body.

The weaker signal strength at closer proximity of the body may be interpreted as proximity or touch by a person not having the authentication device (e.g. transmitter) on or close to his/hers body.

The proximity sensing and electrical field reception may be done fully or partly with the use of same physical electrodes.

The following description of figures of exemplary embodiments may further illustrate and explain the aspects of this disclosure. Devices and circuit blocks with the same structure and the same effect, respectively, appear with equivalent reference symbols. In so far as devices or circuit blocks correspond to one another in terms of their function in different figures, the description thereof is not repeated for each of the following figures.

DETAILED DESCRIPTION

Figures 1A, 1B, 1C:
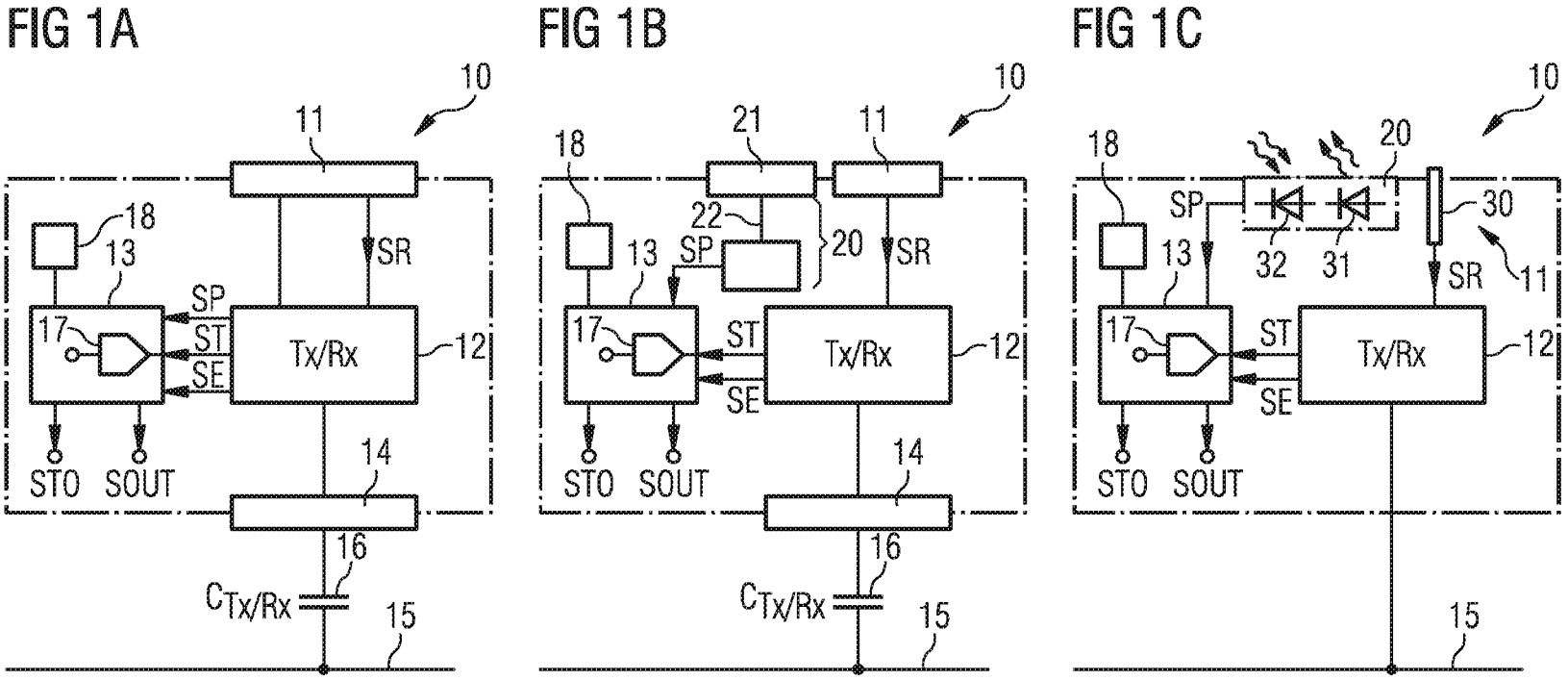
FIGS. 1A to 1C show exemplary embodiments of a communication device.

FIG. 1A shows an exemplary embodiment of a communication device 10. The communication device 10 comprises a conductor 11, a transceiver 12 and a data processing unit 13. The transceiver 12 is coupled to the conductor 11 and to the data processing unit 13. Two connection lines may be arranged between the conductor 11 and the transceiver 12. Moreover, the communication device 10 comprises a ground plate 14 that is coupled to the transceiver 12. The ground plate 14 may be coupled to a reference potential terminal 15. The reference potential terminal 15 may be realized as the earth ground. The ground plate 14 may be capacitively coupled to the reference potential terminal 15. This coupling is illustrated by a coupling capacitor 16 between the ground plate 14 and the reference potential terminal 15. The data processing unit 13 comprises an analog-to-digital converter 17 that may be connected on its input side to an output of the transceiver 12. The data processing unit 13 may comprise a state machine, microprocessor or microcontroller, not shown. The communication device 10 comprises a memory 18 that is coupled to the data processing unit 13.

The communication device 10 may react as a receiver. At the conductor 11 a receiver signal SR can be tapped. The receiver signal SR is provided to the transceiver 12 by the conductor 11. The transceiver 12 generates a received signal SE as a function of the receiver signal SR and provides the received signal SE to the data processing unit 13.

The transceiver 12 determines a strength signal ST out of the receiver signal SR and provides the strength signal ST to the data processing unit 13.

The conductor 11 may also be used for proximity measurement. The conductor 11 and the transceiver 12 may generate a proximity signal SP. The proximity signal SP is provided to the data processing unit 13. The communication device 10 may be configured to use a first and a second phase. In the first phase, the receiver signal SR and the received signal SE are generated and the strength signal ST is determined. In the second phase, the proximity signal SP is determined by the transceiver 12 and the conductor 11. A frequency of the receiver signal SR may be higher than the frequency used for the determination of the proximity signal SP.

The analog-to-digital converter 17 generates a digitized strength signal ST' out of the strength signal ST and a digitized proximity signal SP' out of the proximity signal SP. Alternatively, the data processing unit 13 comprises two analog-to-digital converters to generate the digitized strength signal ST' and the digitized proximity signal SP'. The received signal SE may be also applied to the analog-to-digital converter 17 or a further analog-to-digital converter for generating a digitized received signal SE' out of the received signal SE.

The data processing unit 13 uses the value of the strength signal ST and the value of the proximity signal SP to generate a disable signal STO. The disable signal STO can also be called stop signal. The disable signal STO may be, for example, provided to an electrical door lock, not shown. The disable signal STO may keep the door closed.

The data processing unit 13 generates an output signal SOUT, when an authentication code received by the receiver signal SR is equal to one of the authentication codes stored in the memory 18 and the disable signal STO is not set.

Alternatively, the communication device 10 is implemented not only as a receiver but also as a transmitter. The disable signal STO may prevent the communication device 10 from starting a transmitting phase.

The strength signal ST is generated by the transceiver 12. The transceiver 12 may comprise a circuit measuring the electric power of the receiver signal SR or a power meter, such as a digital electronic power meter or a thermal power meter. The communication device 10 is implemented with two plates, one plate 11 (named conductor 11) for the receiver signal SR and for proximity sensing, another plate 14 (named ground plate 14) for the capacitive coupling with the earth ground 15.

Advantageously only one plate is used for realization of the conductor 11 that receives the receiver signal SR and is designed for proximity measurement. Thus, the communication device 10 can be kept small and may be realized at low cost.

In an alternative, not shown embodiment, the data processing unit 13 determines the strength signal ST, e.g. using the received signal SE or/and the digitized received signal SE'. The strength signal ST may be calculated by the data processing unit 13 out of the average of the amount of the digitized received signal SE'. Alternatively, the strength signal ST may be, for example, the maximum of the digitized received signal SE'.

FIG. 1B shows a further exemplary embodiment of the communication device 10 which is a further development of the embodiment shown in FIG. 1A. The communication device 10 comprises a proximity sensor 20. The proximity sensor 20 is realized as a capacitive proximity sensor. Thus, the proximity sensor 20 comprises a proximity sensor plate 21 and a sensor circuit 22 coupled to the proximity sensor plate 21. The sensor circuit 22 is connected on its output side to an input of the data processing unit 13. The proximity sensor 20 generates the proximity signal SP and provides the proximity signal SP to the data processing unit 13. The data processing unit 13 may comprise an additional analog-to-digital converter or may use the analog-to-digital converter 17 for digitalization of the proximity signal SP.

The proximity sensor plate 21 and the conductor 11 that receives the receiver signal SR are realized as two independent plates which are not short-circuited. In FIG. 1B, the structure of the communication device 10 with three plates 11, 14, 21 is shown. Thus, the human body communication device 10 may be equipped with three plates:

- The signal plate 11 is connected directly to the body and performs the human body communication.
- The ground plate 14 performs the return path for the human body communication.
- The proximity sensor plate 21 performs the activation or de-activation of the transceiver 12, when there is a detection of an external human body in the proximity.

FIG. 1C shows a further exemplary embodiment of the communication device 10 which is a further development of the embodiments shown in FIG. 1A and 1B. The conductor 11 is realized as an antenna 30. The antenna 30 may be implemented as a dipole antenna or as a loop antenna. The communication device 10 comprises the proximity sensor 20 that is realized as an optical proximity sensor. Thus, the proximity sensor 20 may comprise a light-emitting diode 31 and a photodiode 32 and a circuit that generates the proximity signal SP. The light-emitting diode 31 may be realized as IR light-emitting diode. The transceiver 12 may be directly connected to the reference potential terminal 15.

Advantageously, the range for communication by the communication device 10 is increased by the use of the antenna 30. Also the optical proximity sensor 20 has a wider detection range than the capacitive proximity sensor shown in FIGS. 1A and 1B.

Figure 2A:
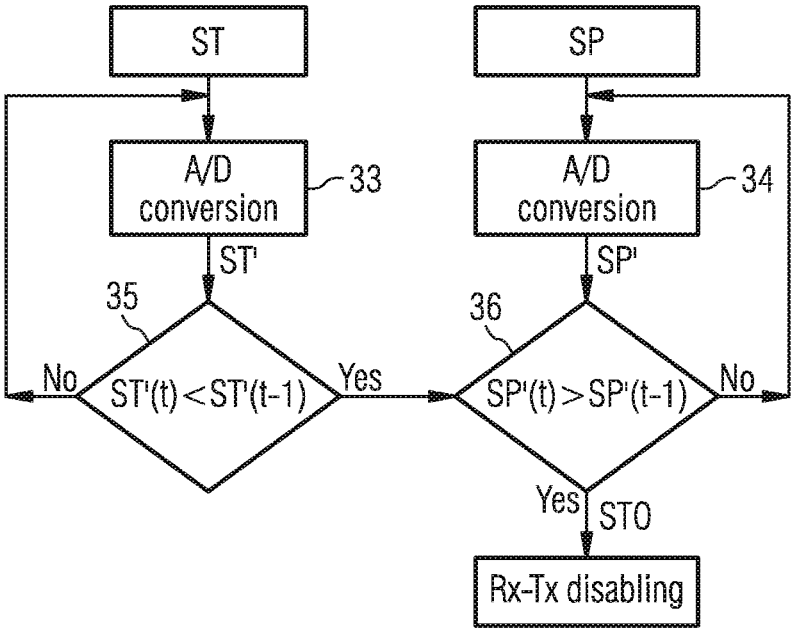
FIGS. 2A and 2B show steps performed in the communication device.

FIG. 2A shows an exemplary embodiment of a method performed by the communication device 10 as shown in FIGS. 1A to 1C. The method may be also called the system diagram. The method may be performed on-line by the data processing unit 13. The strength signal ST is digitized by an analog-to-digital conversion 33 into the digitized strength signal ST'. The present value of the digitized strength signal ST'(t) is compared with a previous value of the digitized strength signal ST'(t−1). If the present value of the digitized strength signal ST'(t) is equal or larger than the previous value of the digitized strength signal ST'(t−1), than a further value of the strength signal ST is digitized.

Correspondingly, the proximity signal SP is digitized into the digitized proximity signal SP' by an analog-to-digital conversion 34. The analog-to-digital conversions 33, 34 may be performed by the analog-to-digital converter 17. If the present value of the digitized strength signal ST'(t) is less than the previous value of the digitized strength signal ST'(t−1), then the present value of the digitized proximity signal SP'(t) is compared with a previous value of the digitized proximity signal SP'(t−1). If the present value of the digitized proximity signal SP'(t) is equal or less than the previous value of the digitized proximity signal SP'(t−1), then the next value of the proximity signal SP is digitized.

However, if the present value of the digitized strength signal ST'(t) is less than the previous value of the digitized strength signal ST'(t−1)and also the present value of the digitized proximity signal SP'(t) is larger than the previous value of the digitized proximity signal SP'(t−1), then the disable signal STO is generated. By the disable signal STO a present communication of the communication device 10 is stopped or a future communication of the communication device is disabled. The disable signal STO can also be called "RX-TX disabling signal".

Figure 2B:
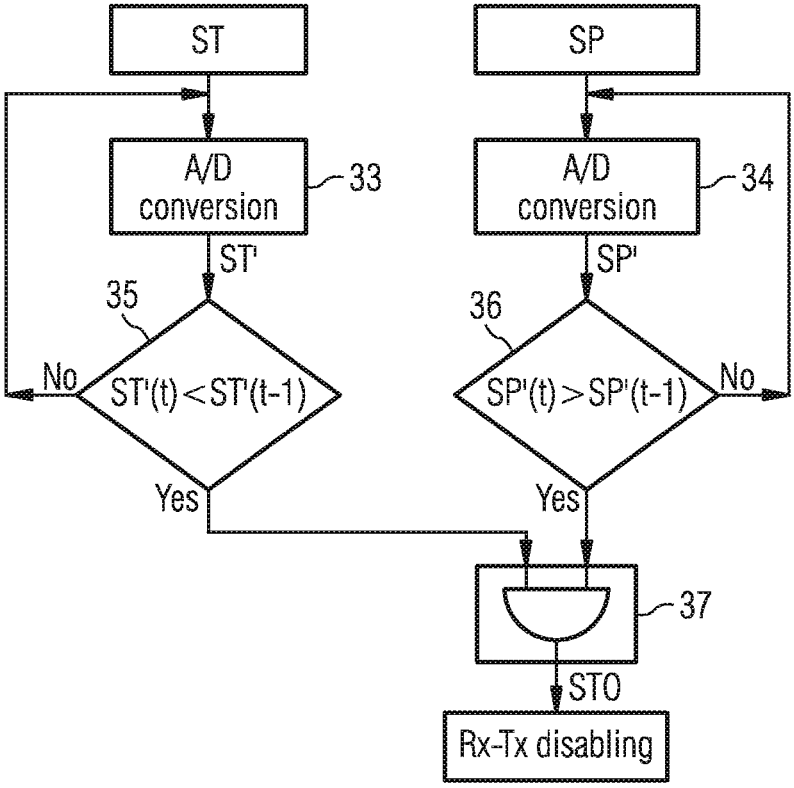

FIG. 2B shows a further exemplary embodiment of the method performed by the communication device 10 as shown in FIGS. 1A to 1C and 2A. The result of the comparison 35 of the present value of the digitized strength signal ST'(t) with the previous value of the digitized strength signal ST'(t−1) is fed to a logical operation 37. Also, the comparison 36 of the present value of the digitized proximity signal SP'(t) and the previous value of the digitized proximity signal SP'(t−1) is fed to the logical operation 37. The logical operation 37 may be, for example, an AND operation. The result of the logical operation 37 is the enable signal STO. The two comparisons 35, 36 and the logical operation 37 may be performed by a hardware comprised by the data processing unit 13 or by software steps performed in the data processing unit 13.

Figures 3A, 3B, 3C:
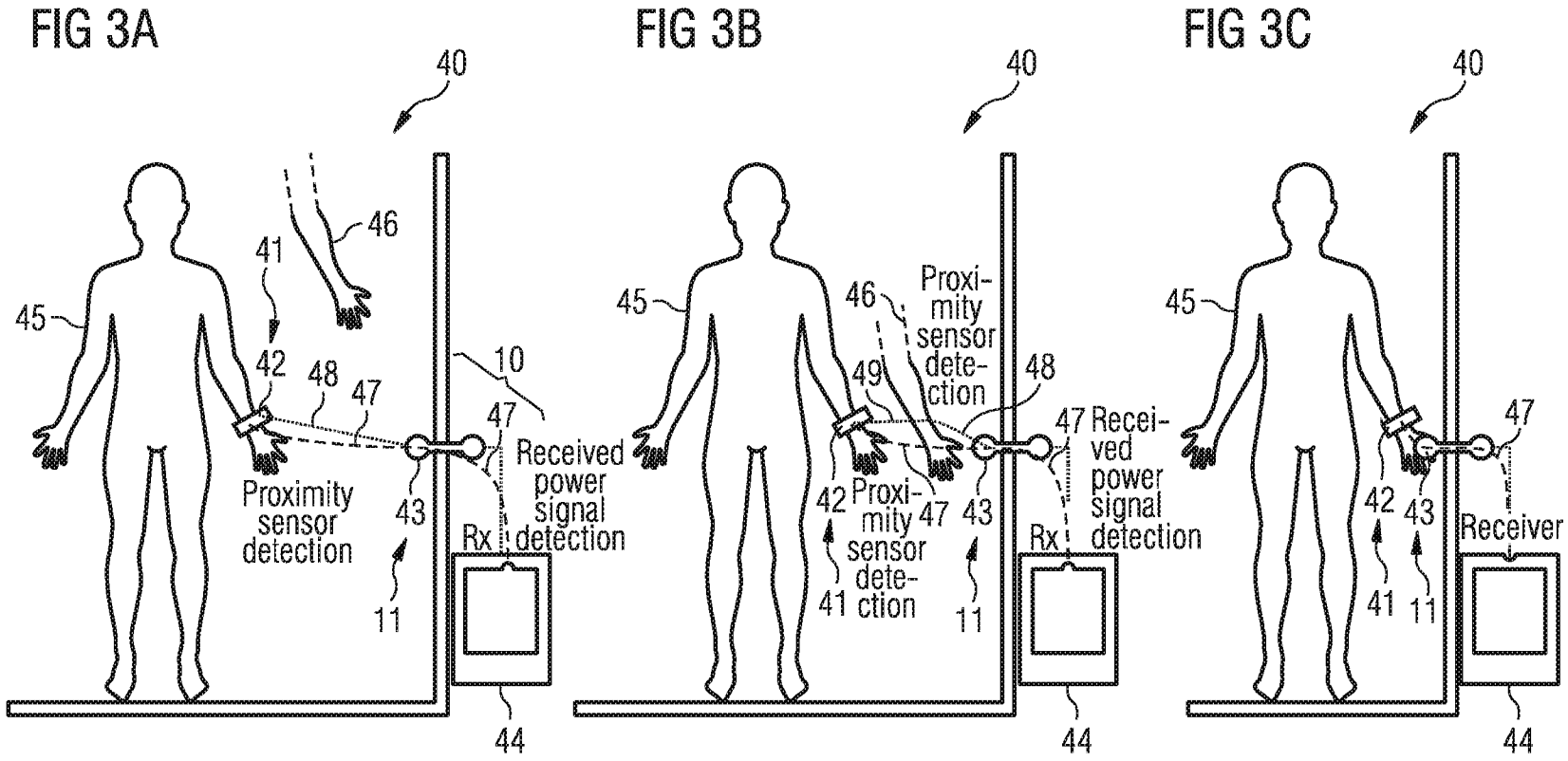
FIGS. 3A to 3C show an exemplary embodiment of a communication arrangement.

FIG. 3A shows an exemplary embodiment of a communication arrangement 40 comprising the communication device 10 as illustrated in FIGS. 1A to 1C, 2A and 2B and a transmitter 41. The conductor 11 is realized as a door knob 43. The door knob 43 is connected via a connection line to a circuitry 44 of the communication device 10. The circuitry 44 may comprise the transceiver 12 and the data processing unit 13 as shown in FIGS. 1A to 1C. The circuitry 44 may be connected to an electric door-closing arrangement, not shown. The transmitter 41 is implemented as a wristwatch 42. A person 45 is wearing the wristwatch 42. The hand of the person 45 having the transmitter 41 is near to the conductor 11, i.e. near to the door knob 43. The transmitter 41 is in the range of the proximity sensor detection provided by the communication device 10. An authentication code is stored in the transmitter 41. A hand of a further person 46 is approaching. A path 47 of electromagnetic waves from the transmitter 41 to the door knob 43 is shown in FIG. 3A. Also the distance 48 measured by the proximity measurement is show.

As shown in FIG. 3B, the hand of the further person 46 is between the transmitter 41 and the conductor 11 realized as a door knob 43. The distance 48 measured by the proximity measurement of the communication device 10 is shorter than the distance measured in FIG. 3A. Also the transmitter 41 may measure a distance 49 from the transmitter 41 to the hand of the further person 46. Thus, the proximity signal SP generated by the communication device 10 is increasing, since the hand of the further person 46 is nearer to the door knob 43 than the transmitter 41 of the person 45. However, the hand of the further person 46 provides some shield for electromagnetic waves. Thus, the strength signal ST determined by the communication device 10 is decreasing. The increase of the proximity signal SP and the decrease of the strength signal ST result in a generation of the disable signal STO as shown in FIGS. 2A and 2B. The disable signal STO will disable the opening of the door. The further person 46 who does not have a transmitter with an authentication code cannot open the door.

In the embodiment shown in FIG. 3C, the further person 46 is not present. The hand of the person 45 is in reach of the conductor 11 and thus of the door knob 43. Therefore, the strength signal ST as well as the proximity signal SP have high and approximately constant values. Since the disabling signal STO is not generated, the transmitter 41 sends the authentication code to the conductor 11 via the hand. When the authentication code received by the communication device 10 is equal to the values of authentication codes stored in the communication device 10, the output signal SOUT is generated by the communication device 10, is provided to the door opening system and is designed to open the door.

In FIGS. 3A to 3C, a door lock authentication case with and without the presence of an external body 46 is illustrated. A communication is established between the person 45 wearing the wristwatch 42 and the door lock 10. The wristwatch 42 has to transmit the authentication data. To do so the person 45 who is wearing the wristwatch 42 while approaching the door starts to send the wake-up signal in order to start the authentication. In the meantime the proximity sensor detects the presence of the door. If the proximity switch has been triggered by the person 45 wearing (having) the authentication transceiver 41, the receive signal strength ST will increases during the time the proximity switch detects proximity as the 'transmitting body' is extremely close.

If the proximity switch is triggered by another person (body) as shown in FIG. 3B, the strength signal ST will not increase but rather decrease since the body 46 triggering the proximity switch is not in possession of the authentication transceiver 41. So this proximity will not increase the strength signal ST (electrical field) but rather reduce it as it will act as a shield electrode.

Figure 4A:
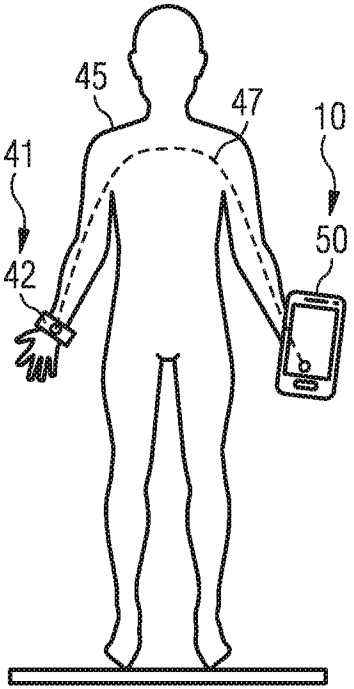
FIGS. 4A to 4C show further exemplary embodiments of a communication arrangement.
Figure 4B:
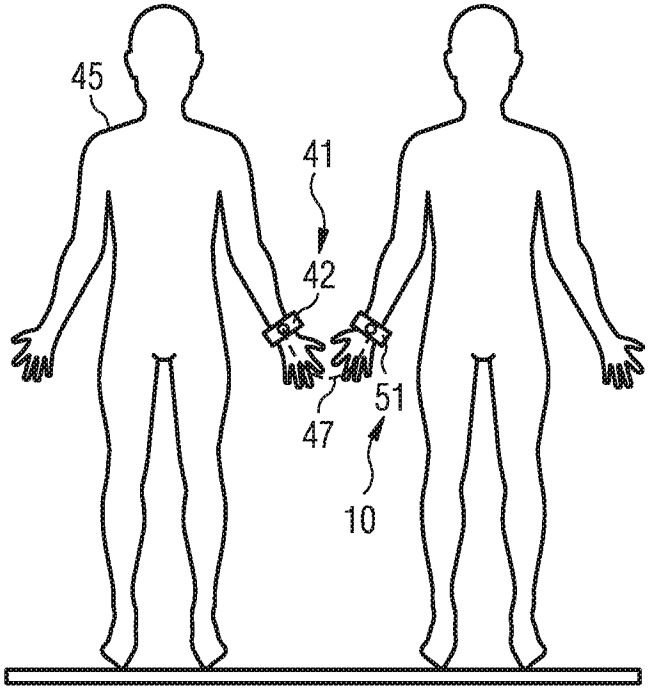
Figure 4C:
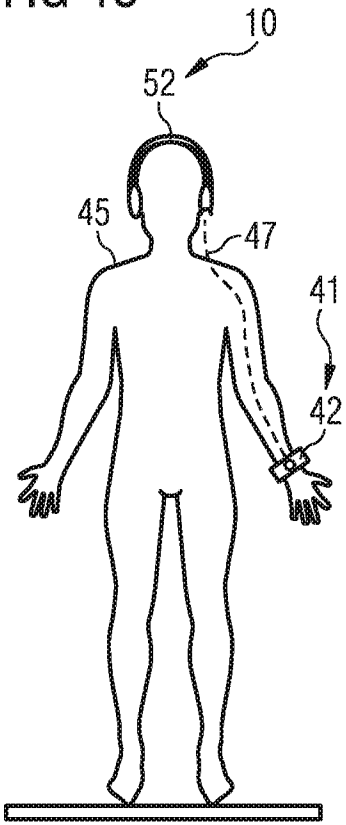

FIGS. 4A to 4C show further exemplary embodiments of a communication arrangement 40 which are further developments of the embodiments shown in the Figures described above. In FIGS. 4A to 4C, possible use cases are illustrated for the human body communication. A human body communication transceiver is needed. As shown in FIG. 4A, the communication device 10 is realized as a mobile communication device 50 such as a mobile phone, a smart phone or laptop. The person 45 not only carries the communication device 10 but also the transmitter 41. Both the transmitter 41 and the communication device 10 are in contact with the body of the person 45. Thus, an electromagnetic transmission along the path 47 may be performed through the body of the person 45. In case the person 45 gives the communication device 10 out of his/her hand and the further person 46 approaches the communication device 10, the proximity signal SP will increase but the strength signal ST will decrease. Thus, the disable signal STO will be generated and a communication between the transmitter 41 and the communication device 10 will be stopped. The device that is modelled as a wristwatch 42 in FIG. 4A includes a wake-up receiver and the proximity sensor. The communication is performed trough the body 45 between the wristwatch 42 and the communication device 10 that is an external device (like a smartphone or a laptop).

As shown in FIG. 4B, the person 45 wears the transmitter 41, whereas the further person 46 wears the communication device 10. The communication device 10 may be realized as a further wristwatch 51. Thus, the person 45 and the further person 46 both wear a wristwatch 42, 51. A communication can be performed between the transmitter 41 and the communication device 10. If a third person, not shown, steps in between the person 45 and the further person 46, the proximity signal SP will increase but the strength signal ST will decrease, resulting in the generation of the disable signal STO. In FIG. 4B, a communication between two bodies exchanging data is shown. The data are exchanged between the two wristwatches 42, 51.

As shown in FIG. 4C, the person 45 wears the communication device 10 in the form of a headphone 52. The headphone 52 communicates with the transmitter 41 in the form of the wristwatch 42. The electromagnetic waves 47 may go through the arm of the person 45. If another person takes the headphone 52, the proximity signal SP may be high but the strength signal ST may decrease. Thus, the disable signal STO is generated. Advantageously, the transmission of data from the transmitter 41 to the communication device 10 in the form of the headphone 52 is stopped. The transmission of audio data is performed between the wristwatch 42 and the head phones or head cuffs 52. The communication arrangement 10 can be applied for all the use case.

The invention claimed is:

1. A communication device, comprising:

a conductor, a transceiver coupled to the conductor and a data processing unit that is coupled to the transceiver, wherein the communication device is configured to determine a strength signal depending on a receiver signal received via the conductor and to determine a proximity signal depending on a proximity of a body to the communication device, and wherein the data processing unit is configured to generate a disable signal when the strength signal decreases and the proximity signal increases, wherein the disable signal depends on at least a value of the strength signal and on at least a value of the proximity signal.

2. The communication device according to claim 1, wherein the data processing unit is configured to generate the disable signal when the strength signal decreases and the proximity signal increases only if, the strength signal decreases larger than a predetermined strength value in a predetermined time and the proximity signal increases larger than a predetermined proximity value in the predetermined time.

3. The communication device according to claim 1, wherein the data processing unit is configured to stop the communication, when the disable signal is generated.

4. The communication device according to claim 1, wherein the communication device comprises a memory that stores at least one authentication code, and wherein the data processing unit is configured to generate an output signal, if an authentication code received by the receiver signal is equal to one of the authentication codes stored in the memory and the disable signal is not set.

5. The communication device according to claim 1, wherein the data processing unit comprises an analog-to-digital converter that is configured to generate at least one of a digitized strength signal and a digitized proximity signal.

6. The communication device according to claim 1, wherein the conductor is implemented as an antenna that is configured to receive electromagnetic waves and to generate the receiver signal.

7. The communication device according to claim 1, wherein the conductor is implemented as a signal plate that is configured to be connected or capacitively coupled to a body and to generate the receiver signal.

8. The communication device according to claim 7, wherein the conductor and the transceiver are configured such that the proximity signal is derived from the receiver signal or another signal tapped at the conductor.

9. The communication device according to claim 1, wherein the communication device comprises a proximity sensor for generating the proximity signal.

10. The communication device according to claim 1, wherein the communication device comprises a ground plate configured for capacitive coupling to a reference potential.

11. A communication arrangement, comprising:

a communication device, comprising:

a conductor, a transceiver coupled to the conductor, and a data processing unit that is coupled to the transceiver, wherein the communication device is configured to determine a strength signal depending on a receiver signal received via the conductor and to determine a proximity signal depending on a proximity of a body to the communication device, and the data processing unit is configured to generate a disable signal when the strength signal decreases and the proximity signal increases, wherein the disable signal depends on at least a value of the strength signal and on at least a value of the proximity signal; and a transmitter.

12. The communication arrangement according to claim 11, wherein the transmitter is configured to communicate with the communication device via human body communication.

13. A method for communication, comprising:

receiving a receiver signal by a conductor of a communication device, converting the receiver signal into a strength signal by the communication device, determining a proximity signal depending on a proximity of a body to the communication device and generating a disable signal by the communication device when the strength signal decreases and the proximity signal increases, wherein the disable signal depends on at least a value of the strength signal and on at least a value of the proximity signal.

* * * * *